US009357859B2

(12) United States Patent
Fanning, Jr. et al.

(10) Patent No.: US 9,357,859 B2
(45) Date of Patent: Jun. 7, 2016

(54) APPARATUS FOR SUPPORTING AND DISPLAYING PAINT COLOR CARDS

(71) Applicant: Benchmarc Display, Inc., Vernon Hills, IL (US)

(72) Inventors: Louis D. Fanning, Jr., Palatine, IL (US); Edwin Paul Miller, Winthrop Harbor, IL (US)

(73) Assignee: Benchmarc Display, Inc., Vernon Hills, IL (US)

( * ) Notice: Subject to any disclaimer, the term of this patent is extended or adjusted under 35 U.S.C. 154(b) by 0 days.

(21) Appl. No.: 14/594,688

(22) Filed: Jan. 12, 2015

(65) Prior Publication Data

US 2015/0122753 A1 May 7, 2015

Related U.S. Application Data

(63) Continuation of application No. 13/034,891, filed on Feb. 25, 2011, now Pat. No. 8,931,746.

(51) Int. Cl.

| | |
|---|---|
| ***A47B 96/06*** | (2006.01) |
| ***A47F 5/08*** | (2006.01) |
| ***A47F 7/00*** | (2006.01) |
| ***A47F 7/14*** | (2006.01) |
| ***A47F 7/16*** | (2006.01) |
| ***G09F 5/04*** | (2006.01) |

(52) U.S. Cl.

CPC ..... *A47F 5/0823* (2013.01); *A47F 7/0007* (2013.01); *A47F 7/0042* (2013.01); *A47F 7/147* (2013.01); *A47F 7/163* (2013.01); *G09F 5/042* (2013.01)

(58) Field of Classification Search

None

See application file for complete search history.

(56) References Cited

U.S. PATENT DOCUMENTS

| | | | | | |
|---|---|---|---|---|---|
| 628,682 | A | * | 7/1899 | Vold | 312/132 |
| 1,103,100 | A | * | 7/1914 | Thompson | 211/58 |
| 1,209,818 | A | * | 12/1916 | Dumont | 40/124.2 |
| 2,879,899 | A | * | 3/1959 | Shenkin | 211/55 |
| 3,507,064 | A | * | 4/1970 | Hammero | 40/124.2 |
| 3,661,269 | A | * | 5/1972 | Scherzer | 211/50 |
| 4,003,470 | A | * | 1/1977 | Lagorio et al. | 211/50 |

(Continued)

FOREIGN PATENT DOCUMENTS

GB 2176694 A 1/1987

*Primary Examiner* — Monica Millner

(74) *Attorney, Agent, or Firm* — Michael G. Johnston; Moore & Van Allen PLLC

(57) ABSTRACT

A bracket for supporting and displaying a planar object comprises an elongated body member including a planar web and a front wall and a rear wall extending from the longitudinal edges of the web. An end wall extends transversely with respect to and engages the distal ends of the web, the front wall and the rear wall such that the web and the front and rear walls and the end wall define a longitudinal channel open at the proximal end and closed at the distal end for supporting the objects. A pair of arms extend rearwardly from the body member. At least one of the arms is resiliently deflectable for engagement and retention of the lugs in an aperture of a mounting substrate. During connection, lugs on the arms are adapted to engage the portion of the mounting substrate defining the aperture for moving the arms inwardly so that the lugs pass through the aperture for permitting the arms to move outwardly and the lugs to engage the mounting substrate. The channels of adjacent brackets face each other for receiving and supporting at least a portion of the planar objects extending between the facing channels for visual observation and ease of removal of the objects for inspection.

24 Claims, 12 Drawing Sheets

(56) References Cited

U.S. PATENT DOCUMENTS

| | | | | | |
|---|---|---|---|---|---|
| 4,081,080 | A | * | 3/1978 | Rorex | 211/55 |
| 4,102,072 | A | * | 7/1978 | Buschman | 40/124.2 |
| D255,300 | S | * | 6/1980 | Charles | D6/571 |
| 4,217,985 | A | * | 8/1980 | Nasgowitz | 211/50 |
| 4,265,038 | A | * | 5/1981 | Crosslen | 40/124.2 |
| 5,312,001 | A | * | 5/1994 | Sorensen | 211/50 |
| 5,836,459 | A | * | 11/1998 | Nezwek et al. | 211/50 |
| 5,915,571 | A | * | 6/1999 | Czalkiewicz et al. | 211/55 |
| 6,006,927 | A | * | 12/1999 | Levy | 211/51 |
| 6,213,313 | B1 | * | 4/2001 | Levy | 211/51 |
| 6,450,348 | B1 | * | 9/2002 | Lillelund et al. | 211/71.01 |
| 6,578,718 | B2 | * | 6/2003 | Levy | 211/50 |
| 6,698,599 | B1 | * | 3/2004 | Hannecke | 211/51 |
| 7,204,376 | B2 | * | 4/2007 | Richardson et al. | 211/189 |
| 7,751,823 | B2 | * | 7/2010 | Karabinis | 455/450 |
| 7,909,182 | B2 | * | 3/2011 | Maier-Hunke | 211/55 |
| 7,987,999 | B2 | * | 8/2011 | Weigand et al. | 211/55 |
| 8,132,679 | B2 | * | 3/2012 | Berry et al. | 211/55 |
| 8,136,677 | B2 | * | 3/2012 | Brozak et al. | 211/50 |
| 8,931,746 | B2 | * | 1/2015 | Fanning et al. | 248/220.31 |
| 2005/0102918 | A1 | * | 5/2005 | Richardson et al. | 52/79.1 |
| 2008/0078728 | A1 | * | 4/2008 | Hodge | 211/55 |
| 2008/0209778 | A1 | * | 9/2008 | DaRif et al. | 40/124.2 |
| 2009/0223913 | A1 | * | 9/2009 | Shen | 211/55 |

* cited by examiner

APPARATUS FOR SUPPORTING AND DISPLAYING PAINT COLOR CARDS

CROSS-REFERENCES

This application is a continuation application of U.S. patent application Ser. No. 13/034,891, filed Feb. 25, 2011, now U.S. Pat. No. 8,931,746, the contents of which are incorporated herein by reference.

BACKGROUND

This invention relates generally to an apparatus for supporting and displaying objects, and more particularly to structures mountable on a supporting surface and suitable for supporting and displaying planar objects including printed media, such as paint color cards used in the sale of paints.

In the marketing of paint it is desirable to provide paint color cards, or "paint chips", to prospective paint customers for demonstrating colors and surface finishes corresponding to the effects obtained by using the different colors and types of paint being marketed. Such paint chips can be typically characterized as small pieces of heavy paper or cardboard having a finish on a surface corresponding to at least one paint color and finish intended to be represented.

Display of such paint chips typically involves the use of suitable stands or display devices permitting the customer to select one or more paint chips representative of paint colors and finishes for purchase. Paint chips are typically displayed in close proximity to each other, in a stacked manner, to allow the prospective paint customer to concurrently compare various colors and finishes of the varying paints, while simultaneously being able to remove a paint chip revealing another paint chip representative of the same color and finish as represented by the removed paint chip. Such display devices incorporate supports or pockets that are supported on a mounting panel. The pockets are adapted to hold a plurality of paint chips, which may be removed by the prospective customers.

There is a need for a paint chip support for use in conjunction with a display device in which the vertical and horizontal spacing of columns and rows is customizable, with provision for adjustment to accommodate paint chips of different sizes to be displayed simultaneously. Ideally, the paint chip supports should be configured to facilitate installation without need for tools or removal of paint chips from the display. It would be desirable that the new paint chip supports could be installed in a cascading or side-by-side arrangement in order to vary the visual effect and density of pockets on the supporting surface of the display device.

SUMMARY

An apparatus is provided for supporting and displaying a planar object when connected to a mounting substrate defining at least one aperture. The supporting and displaying apparatus comprises an elongated body member having a longitudinal axis. The body member comprises a planar web terminating in longitudinal edges, and a front wall and a rear wall extending from the longitudinal edges of the web and terminating in longitudinal edges. The front wall and the rear wall extend the length of the web. The web, the front wall and the rear wall terminate at their proximal ends in free edges. An end wall extends transversely with respect to and engages the distal ends of the web, the front wall and the rear wall such that the web and the front and rear walls and the end wall define a longitudinal channel open at the proximal end and closed at the distal end for supporting the objects. A pair of arms extend rearwardly from the body member and are formed on their ends with lugs extending transversely in opposite directions. At least one of the arms is resiliently deflectable in a direction transversely of the longitudinal axis of the body member for engagement and retention of the lugs in the at least one aperture of the mounting substrate. During connection of the supporting and displaying apparatus to the mounting substrate the lugs are adapted to engage the portion of the mounting substrate defining the at least one aperture for moving the at least one of the arms inwardly so that the lugs pass through the aperture for permitting the arms to move outwardly and engage the mounting substrate to releasably connect the body member to the mounting substrate. To disconnect the body member, the arms are moved inwardly causing disengagement of the lugs from the mounting substrate so that the lugs pass through the opening allowing the body member to be moved away from the mounting substrate.

A system is also provided for supporting and displaying planar objects. The supporting and displaying system comprises a substrate having a mounting surface defining a plurality of spaced openings. A plurality of brackets for receiving and supporting the objects are provided. Each bracket comprises an elongated body member having a longitudinal axis, the body member including a planar web terminating in longitudinal edges. A front wall and a rear wall extend from the longitudinal edges of the web and terminate in longitudinal edges, the front wall and the rear wall extending the length of the web, and the web, the front wall and the rear wall terminating at their proximal ends in free edges. An end wall extends transversely with respect to and engages the distal ends of the web, the front wall and the rear wall such that the web and the front and rear walls and the end wall define a longitudinal channel open at the proximal end and closed at the distal end for supporting the objects. A pair of arms extend rearwardly from the body member. The arms are formed on their ends with lugs extending transversely in opposite directions, at least one of the arms resiliently deflectable in a direction transversely of the longitudinal axis of the body member for engagement and retention of the lugs in the at least one aperture of the mounting substrate. During connection of the brackets to the substrate the lugs are adapted to engage the mounting surface defining the at least one opening for moving the at least one of the arms inwardly so that the lugs pass through the opening permitting the arms to move outwardly and the lugs to engage the substrate to releasably connect the brackets to the substrate in spaced relationship. The channels of adjacent brackets face each other for receiving and supporting at least a portion of the planar objects extending between the facing channels of the brackets for visual observation and ease of removal of the objects for inspection. To disconnect the bracket, the arms are moved inwardly causing disengagement of the lugs from the substrate so that the lugs pass through the opening allowing the bracket to be moved away from the substrate.

BRIEF DESCRIPTION OF THE DRAWINGS

For a more complete understanding of the present invention, reference should now be had to the embodiments shown in the accompanying drawings and described below. In the drawings.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the components may be oriented in any direction and the terminology, therefore, should be understood as encompassing such variations unless specified otherwise.

Figure 1:
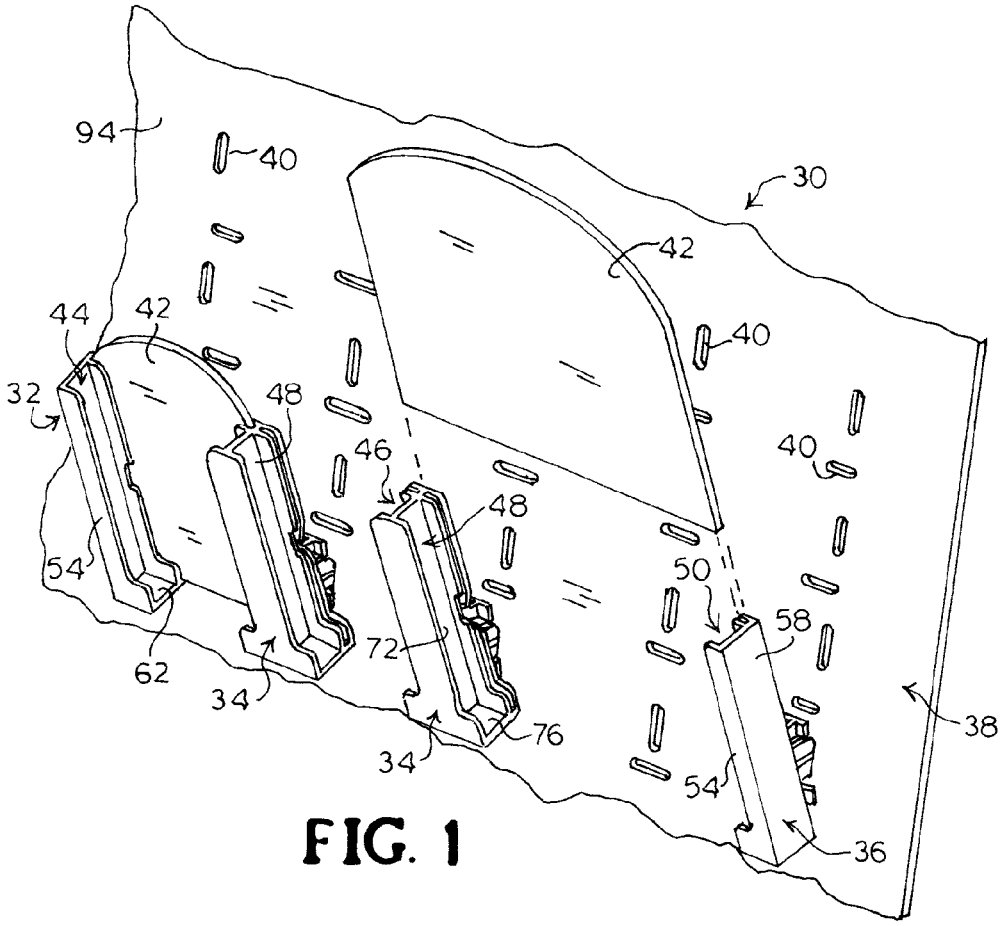
FIG. 1 is a perspective view of an embodiment of an apparatus for supporting and displaying paint color cards showing a first paint color card held in a first pocket and a second paint color card exploded from a second pocket.
Figure 1A:
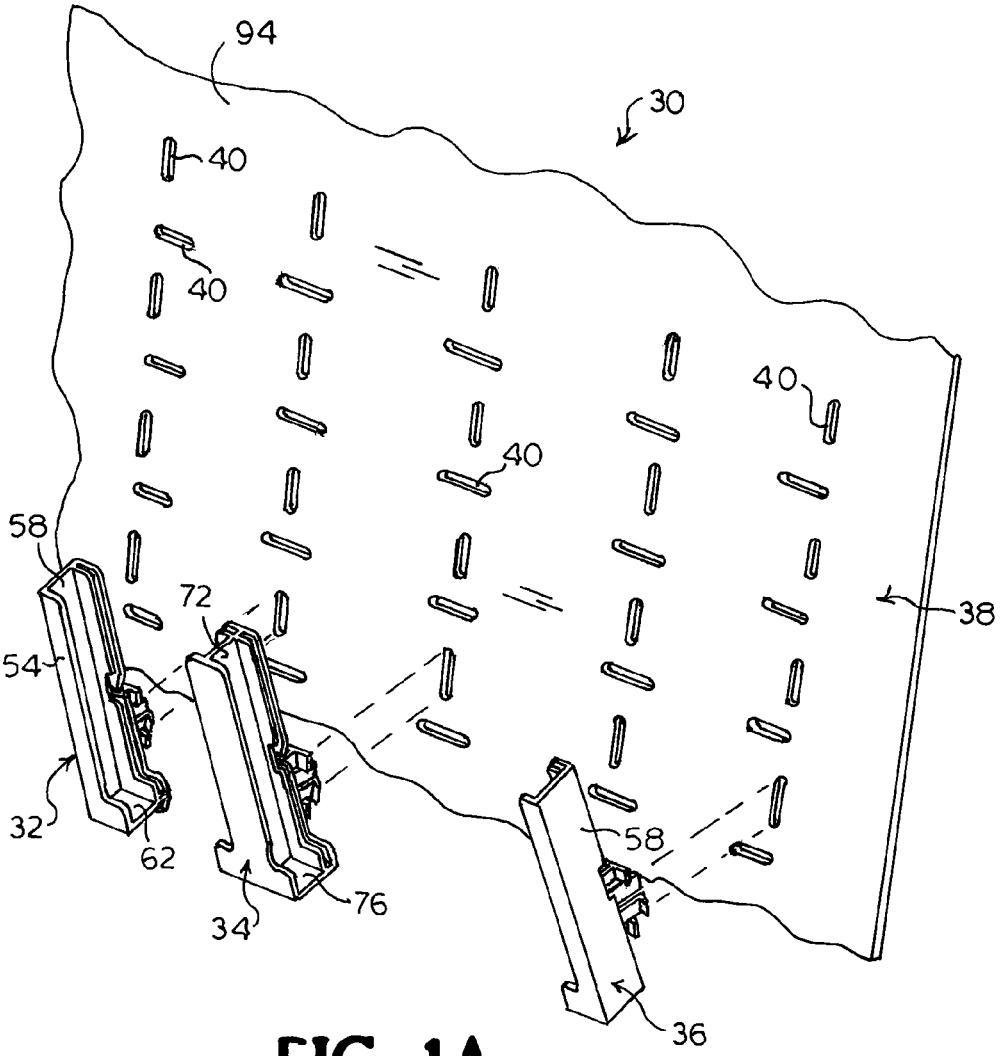
FIG. 1A is an exploded perspective view of the apparatus for supporting and displaying paint color cards as shown in FIG. 1 without the paint color cards.
Figure 2:
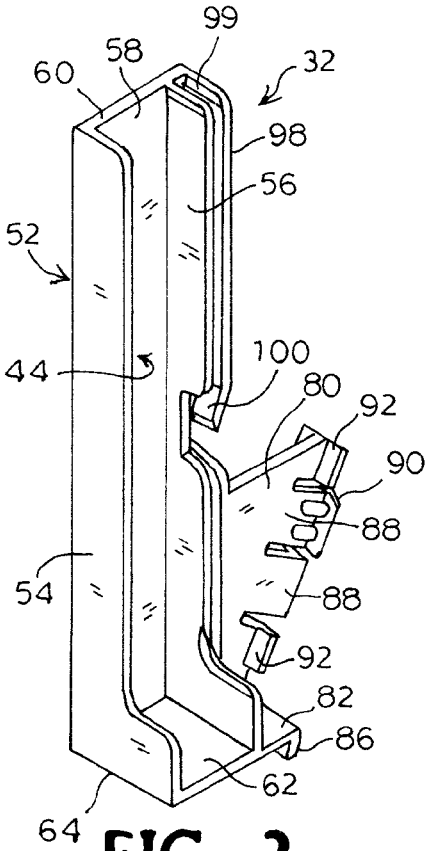
FIG. 2 is a perspective view of an embodiment of a first end bracket for forming the first pocket as shown in FIG. 1.
Figure 3:
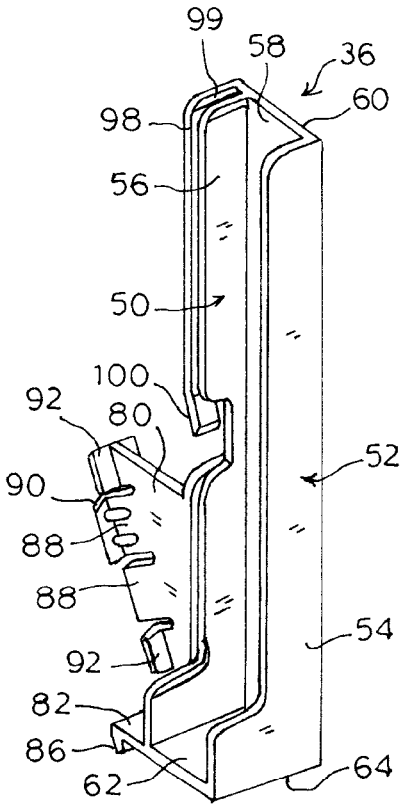
FIG. 3 is a perspective view of an embodiment of a second end bracket for forming the second pocket as shown in FIG. 1.

Referring now to the drawings, wherein like reference numerals designate corresponding or similar elements throughout the several views, an apparatus for supporting a paint color card, or "paint chip", for display is shown in FIG. 1, and generally designated at 30. The supporting apparatus 30 comprises a plurality of paint chip brackets 32, 34, 36 that may be selectively removably positioned on a base mounting panel 38 having a plurality of apertures 40. The brackets comprise a left end bracket 32 (as viewed in FIG. 1), an intermediate bracket 34, and a right end bracket 36. When installed, each of the brackets 32, 34, 36 extends at an angle with respect to the plane of the mounting panel 38. As seen in FIG. 1, the brackets 32, 34, 36 define channels 44, 46, 48, 50, and the channels of adjacent brackets face each other forming a series of spaced forwardly and upwardly opening pockets. The pockets are configured for receiving for display paint chips 42, which slide into the channels 44, 46, 48, 50 defined by the brackets 32, 34, 36. The depth of the channels 44, 46, 48, 50 may vary depending upon dimensional requirements, but in one embodiment are of a suitable depth for holding a plurality of paint chips in a front-to-back stacked manner.

Referring to FIGS. 2-5, each end bracket 32, 36 is formed of an elongate member 52 generally having a C-shape in transverse cross-section. The end brackets 32, 36 include a front wall 54 and an opposite rear wall 56 joined along their edges by a longitudinal side wall 58. The front, rear and side walls 54, 56, 58 define a generally rectangularly-shaped channel 44, 50 for receiving paint chips. The upper ends 60 of the channels 44, 50 are open. An end wall 62 extends transversely between and joins the ends of the front, rear and side walls 54, 56, 58 for closing the lower ends 64 of the channels 44, 50.

Figure 6:
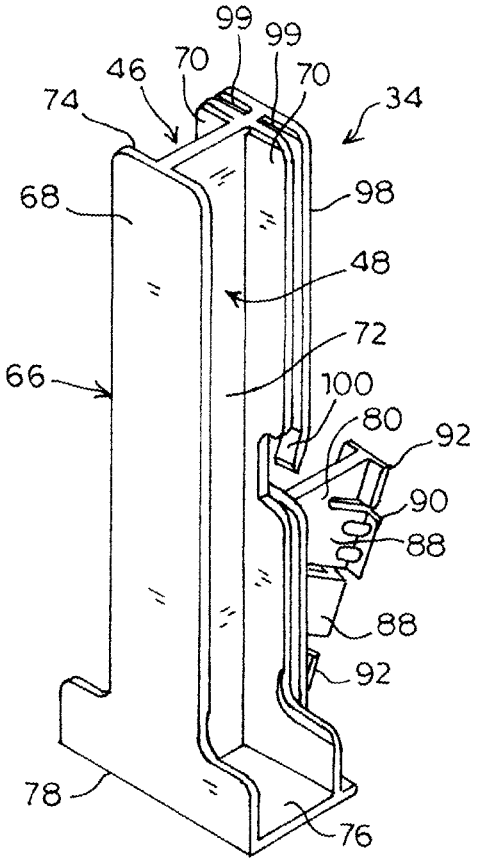
FIG. 6 is a perspective view of an embodiment of an intermediate bracket for forming the first pocket and the second pocket as shown in FIG. 1.
Figure 7:
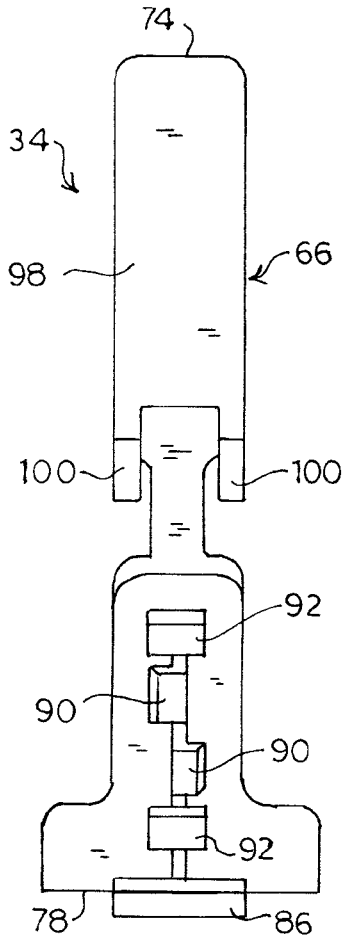
FIG. 7 is a rear elevation view of the intermediate bracket as shown in FIG. 6.
Figure 8:
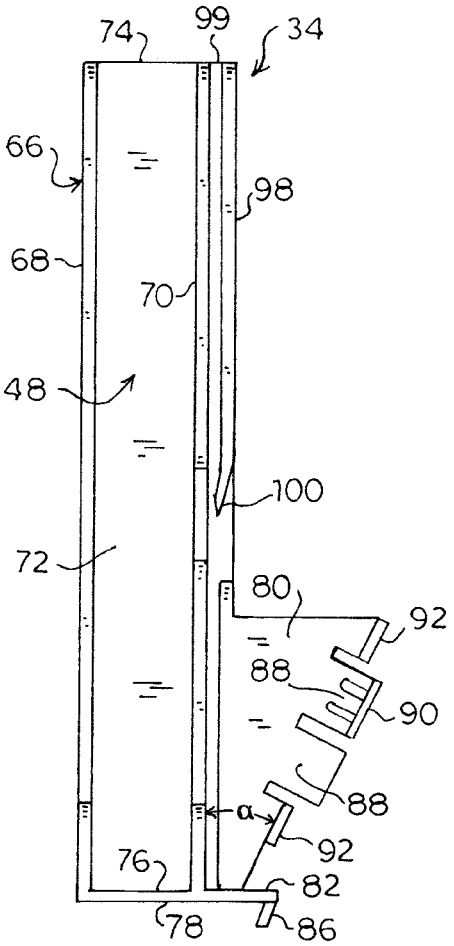
FIG. 8 is a side elevation view of the intermediate bracket as shown in FIG. 6.

Referring to FIGS. 6-8, the intermediate bracket 34 is formed of an elongate member 66 generally having an H-shape in transverse cross-section. The intermediate bracket 34 includes a front wall 68 and a rear wall 70. A longitudinal web 72 extends between and rigidly connects the front and rear walls 68, 70 between the longitudinal edges of the front and rear walls 68, 70. In this configuration, the front and rear walls 68, 70 and the web 72 of the intermediate bracket 34 define the pair of longitudinal channels 46, 48 described above. The channels 46, 48 are arranged back-to-back so as to open laterally outwardly in opposite directions. The upper end 74 of the channels 46, 48 are open. An end wall 76 extends transversely between and joins the ends of the front and rear walls 68, 70 and the web 72 for closing the lower ends 78 of the channels 46, 48.

Each bracket 32, 34, 36 includes a planar longitudinal base plate 80 extending rearwardly from the bracket. As best seen in FIGS. 4, 5, 7 and 8, the base plate 80 tapers outwardly from the closed lower ends 64, 78 of the brackets 32, 34, 36. In this configuration, the outer edge of the base plate 80 forms an angle a with the rear walls 56, 70, such that the angle a is acute. Means for interlocking engagement of the brackets 32, 34, 36 to the mounting panel 38 are provided for holding the brackets in securely assembled relation to the mounting panel 38. The interlocking means comprises a mounting flange 82 and at least one panel engaging clip. The mounting flange 82 is substantially rectangular and is formed integrally with the end walls 62, 76 at the lower ends 64, 78 of the brackets 32, 34, 36. The distal end of the mounting flange 82 terminates in a hook portion 86, which extends downwardly and substantially perpendicular to the rear edge of the base plate 80. As will be described below, the hook portion 86 is insertable in an aperture 40 in the mounting panel 38 for removably supporting the brackets 32, 34, 36 on the mounting panel 38.

Figure 4:
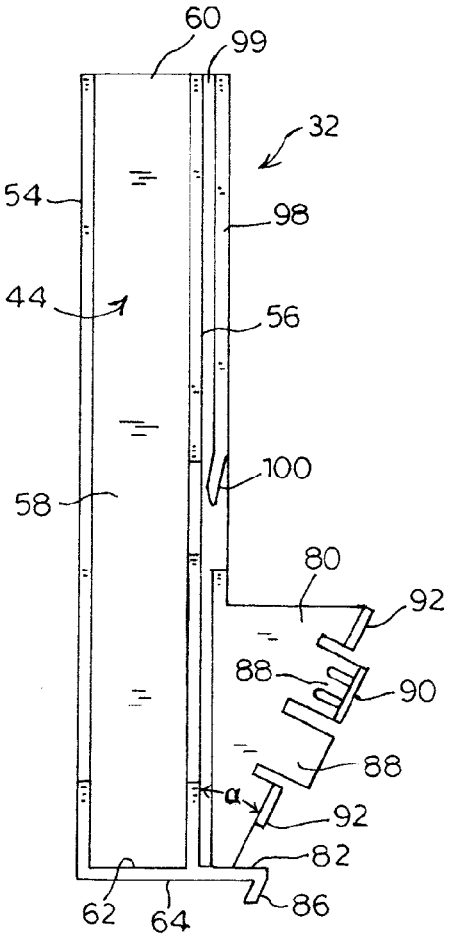
FIG. 4 is an inner side elevation view of the first end bracket as shown in FIG. 2, the inner side elevation view of the second end bracket as shown in FIG. 3 being a mirror image thereof.
Figure 5:
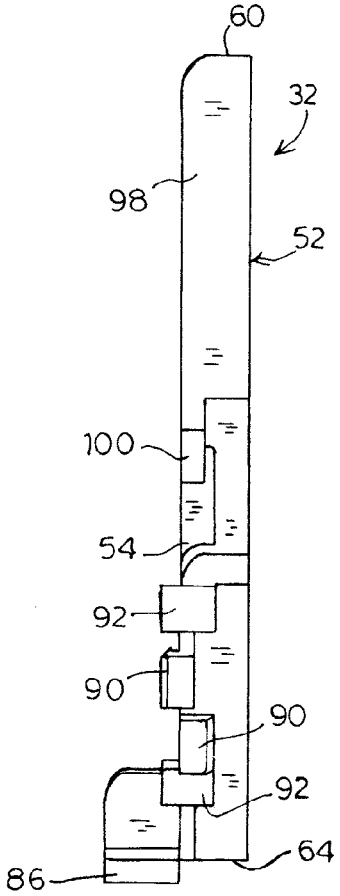
FIG. 5 is a rear elevation view of the first end bracket as shown in FIG. 2, the rear elevation view of the second end bracket as shown in FIG. 3 being a mirror image thereof.

The at least one panel engaging clip is depicted as upper and lower clips projecting rearwardly from the base plate 80. The clips include longitudinally spaced, rearwardly extending arm portions 88. The arms 88 are provided with tabs 90 on their distal ends. The tabs 90 extend perpendicularly in opposite directions from the ends of the arms 88. Bounding the panel engaging clips are support flanges 92 extending perpendicularly from the edge of the base plate 80. As best seen in FIGS. 4 and 8, the arms 88 of the panel engaging clips extend rearwardly a greater distance than the support flanges 92.

As will be described below, the tabs 90 are adapted to be inserted through apertures 40 in the mounting panel 38 and engage the walls of the mounting panel 38 that define the apertures 40 for securing the bracket to the mounting panel 38. For this reason, the arms 88 or the mounting panel 38 are preferably at least slightly resiliently deflectable, which resilience may be easily achieved by proper proportioning of their thickness relative to the projecting distance. It is understood that the drawings herein depict a plurality of panel engaging clips 84 and a vertical arrangement. A single clip or a substantially horizontal arrangement of one or a plurality of arms may also be selected.

The mounting panel 38 (FIG. 1) comprises a planar plate-like member having a plurality of spaced apertures 40 formed through the mounting panel 38 and arranged in rows and columns. The mounting panel 38 may be any shape, rectangular being only one example. The mounting panel 38 has a front mounting surface 94 against which the brackets are mounted. The apertures 40 are configured to receive the hook portion 86 of the mounting flange 82 and the tabs 90 of the panel engaging clips, respectively, to secure the brackets 32, 34, 36 on the mounting panel 38. It is understood that the dimensions of the apertures 40 may be selected to snugly receive the hook portion 86 of the mounting flange 82 and the tabs 90 of the panel engaging clips. In this respect, the specific length and height of the apertures 40 may vary depending on the dimensions of the interlocking means to be received.

The brackets 32, 34, 36 may be formed from a number of acceptable materials, including plastics and metals. Brackets 32, 34, 36 formed of plastic are bendable and resilient to a certain extent and thus insure that the brackets can be readily assembled and snapped to, and removed from, the mounting panel 38. In one embodiment, the brackets 32, 34, 36 are made of thermoformed, extruded or molded plastic resins. One suitable example of such a resin is styrene resin. In a further embodiment, a bracket is substantially clear or transparent allowing the visualization of the material held in the pockets formed by the brackets. The mounting panel 38 may also be formed from a number of acceptable materials, including plastics and metals. A, plate-like rigid sheet material is suitable for the mounting panel 38, such as polycarbonate, polyvinylchloride, medium density fiberboard, and plywood. It is understood that the scope of the invention is not intended to be limited by the materials listed here, but may be carried out using any material which allows the construction and operation of the supporting and displaying apparatus described herein.

Figure 9:
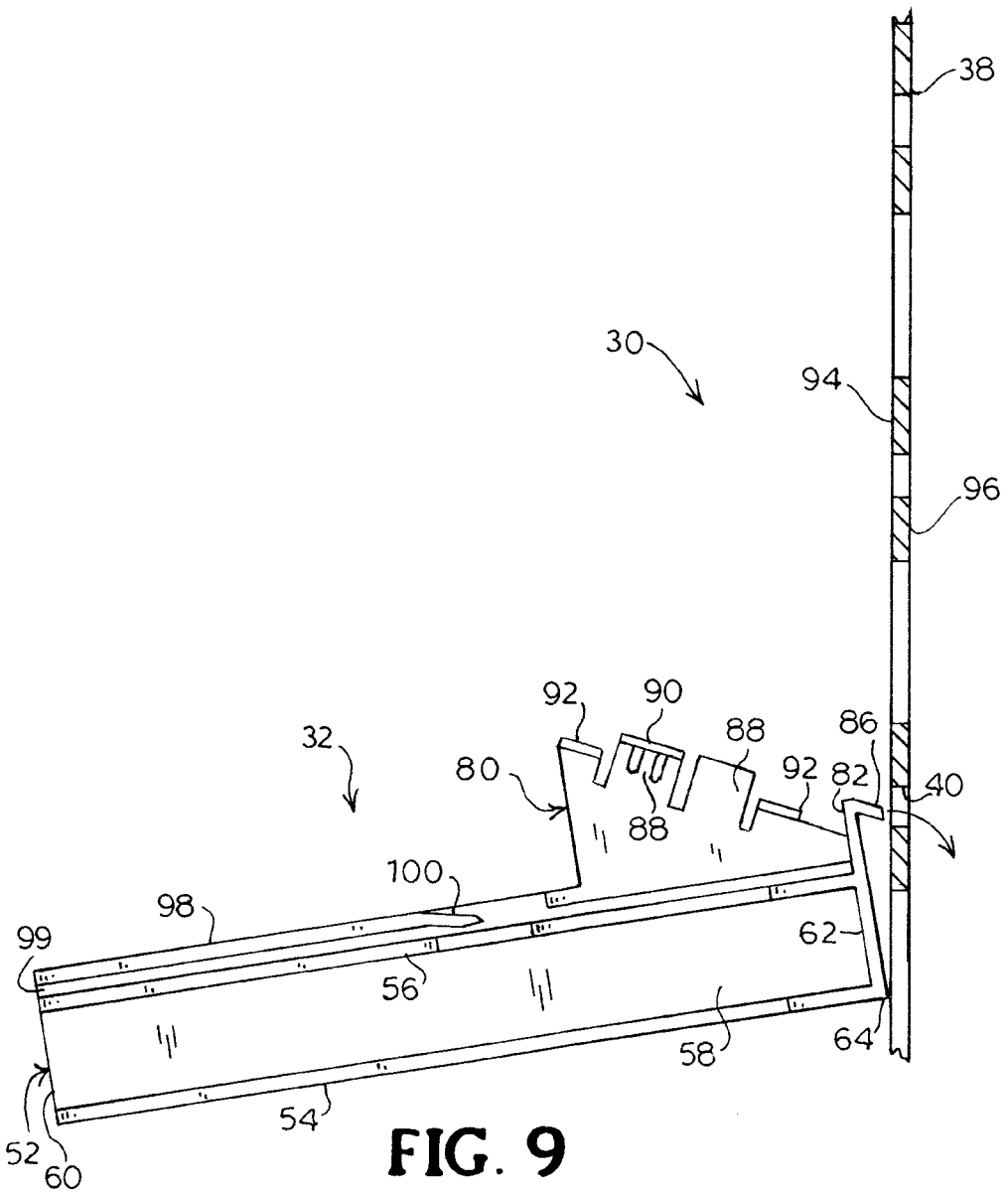
FIG. 9 is a side elevation cross-section view of an apparatus for supporting and displaying paint color cards showing an end bracket being inserted.
Figure 10:
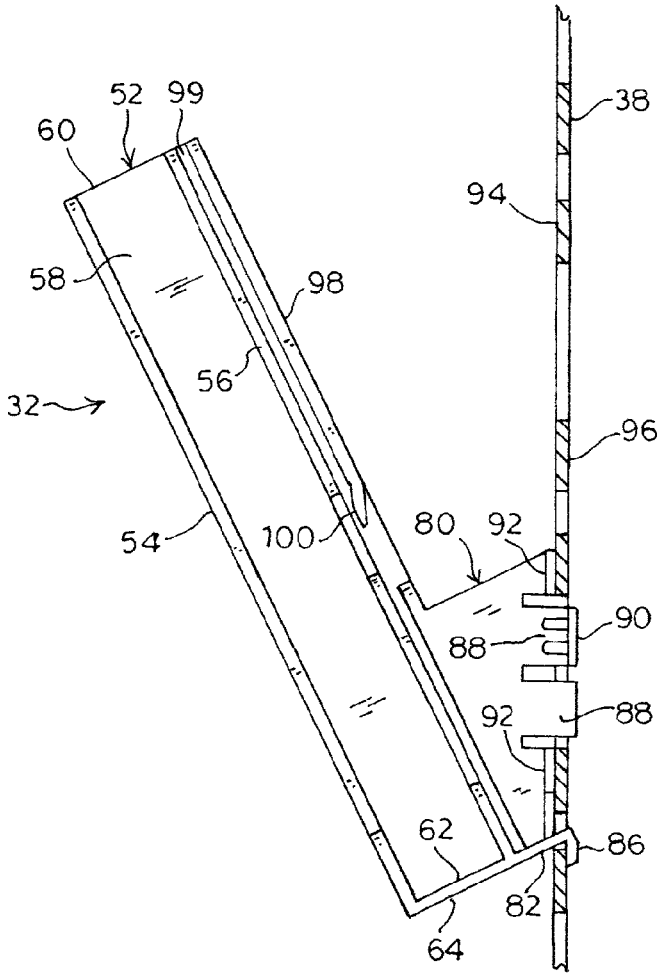
FIG. 10 is a side elevation cross-section view as shown in FIG. 9 with the end bracket inserted.
Figure 11:
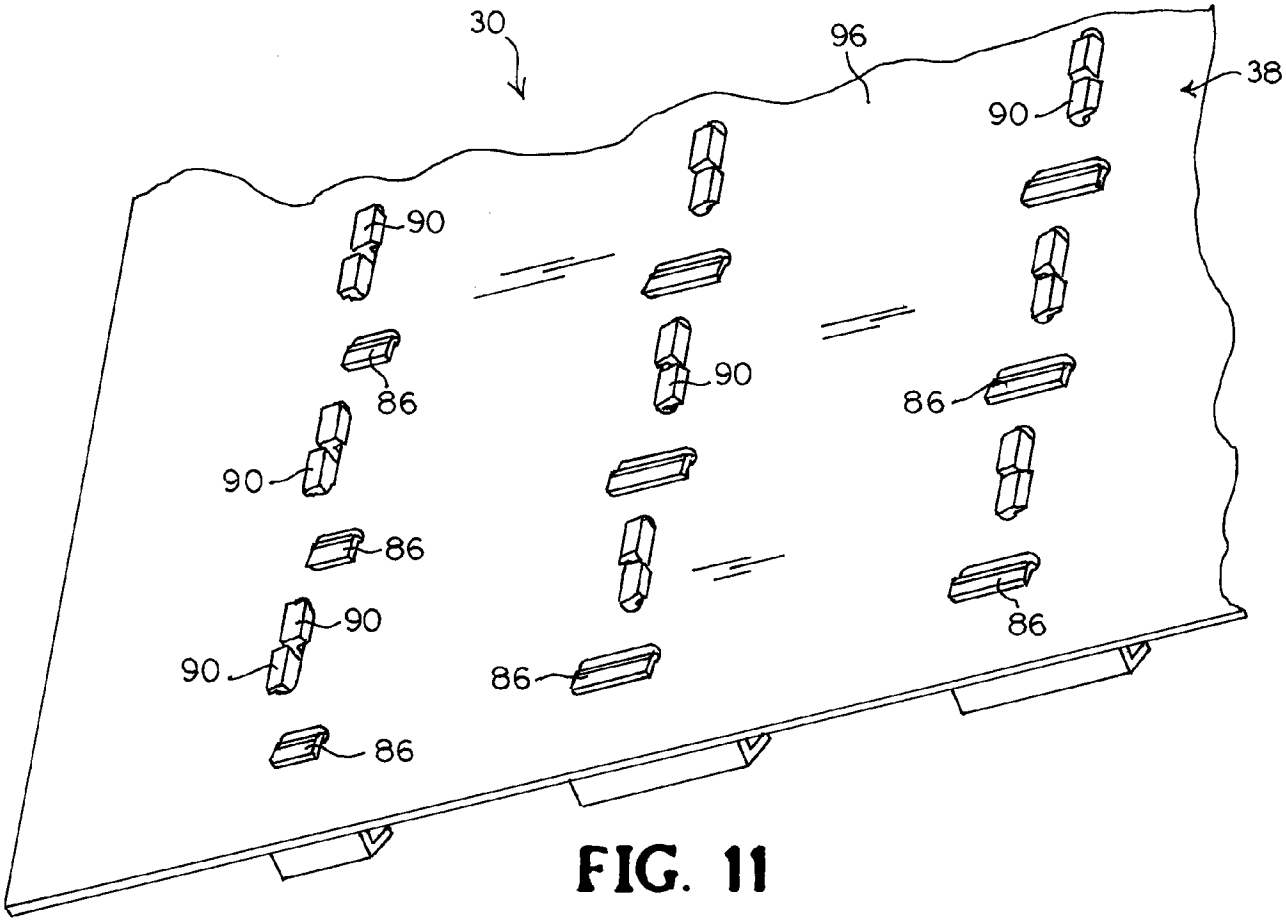
FIG. 11 is a rear perspective view of an embodiment of a mounting panel for use with an apparatus for supporting and displaying paint color cards including a plurality of brackets installed on the mounting panel.
Figure 11A:
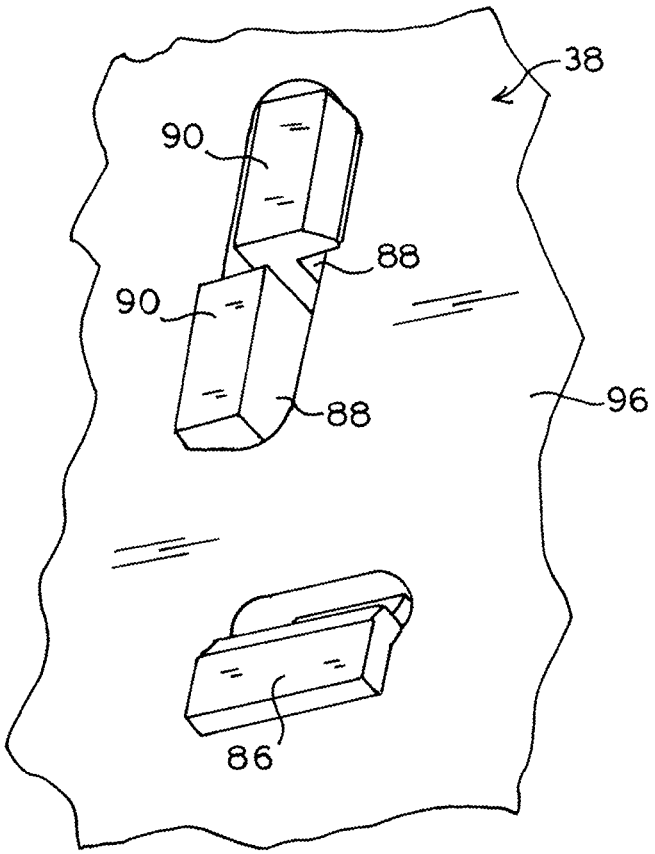
FIG. 11A is a close-up perspective view of the mounting panel as shown in FIG. 11 showing an installed end bracket.

FIGS. 9 and 10 illustrate a method of installing or detaching a bracket relative to the mounting panel 38. Installing a bracket includes inserting the distal hook portion 86 of the lower mounting flange 82 in a corresponding aperture 40 dimensioned to receive the hook portion 86. The bracket is then pivoted at the mounting flange 82 toward the mounting panel 38 so that the tabs 90 of the panel engaging clips are initially brought into registry with a pair of corresponding apertures 40 in the mounting panel 38. The panel engaging clips are interlocked with the mounting panel 38 by manually urging the tabs 90 into the apertures 40. The arms 88 may be deformable, meaning they may bend or otherwise be altered in shape, to allow the tabs 90 to fit through the apertures 40. The arms 88 are also resilient, meaning they will resist deformation and substantially return to their original shape when outside forces are no longer being applied. The walls of the mounting panel 38 defining adjacent the apertures 40 will engage the tabs 90 and the arms 88 will bend slightly inwardly toward each other due to manual pressure toward the mounting panel 38. Since the arms 88 are resilient, they will resist being compressed toward each other and will, upon the tabs 90 clearing the apertures 40, resiliently press outwardly on the walls of the mounting panel 38 thereby holding the bracket in place by engagement of the tabs 90 with the rear surface 96 of the panel 38 (FIGS. 11 and 11A). With the tabs 90 inserted through the apertures 40, the support flanges 92 rest against the front surface 94 of the mounting panel 38, acting as a stop for limiting movement of the bracket toward the mounting panel 38 (FIG. 10). The tabs 90 prevent the bracket from readily backing out of the apertures 40 without again compressing the arms 88 inwardly so that the tabs 90 clear the walls defining the apertures 40.

The angular rearward extension of the base plate 80 relative to the elongate member causes the bracket 32, 34, 36, when installed on the mounting panel 38, to cant away from the front surface 94 of the mounting panel 38. The closed lower end 64 of the bracket is adjacent to, and may be seated against, the mounting panel 38. The open upper end 60 of the bracket is spaced from the mounting panel 38. In one embodiment, the bracket may cant forward from the mounting panel 38 at an angle of from between about 0 degrees and about 60 degrees. Canting the bracket away from the mounting panel 38 may be desirable to cause the associated pocket to sit more vertically in the display, to facilitate proper illumination of the materials disposed in the pockets, and the like. Canting the bracket also allows both visual and manual access to the paint chips or other supported articles. Further, this arrangement enables the upper end of a lower bracket to partially overlap the lower end of an upper bracket for a vertically cascading arrangement of brackets 32, 34, 36. It is understood that a varying angle of orientation of the base plate 80, and thus the brackets, may be used throughout the vertical range of the display. The angular variation of the brackets may be linear or non-linear, tilted toward or away from the front surface 94 of the mounting panel 38.

To remove an installed bracket 32, 34, 36 from the mounting panel 38, the arms 88 are manually compressed inwardly sufficiently to disengage the tabs 90 from the wall of the mounting panel 38 and allow the tabs 90 to pass through the apertures 40. In this position, the bracket 32, 34, 36 is pulled out of the apertures 40 by pivoting the bracket at the mounting flange 82 away from the mounting panel 38 so that the hook portion 86 clears the corresponding aperture 40 (FIG. 9).

Figure 12:
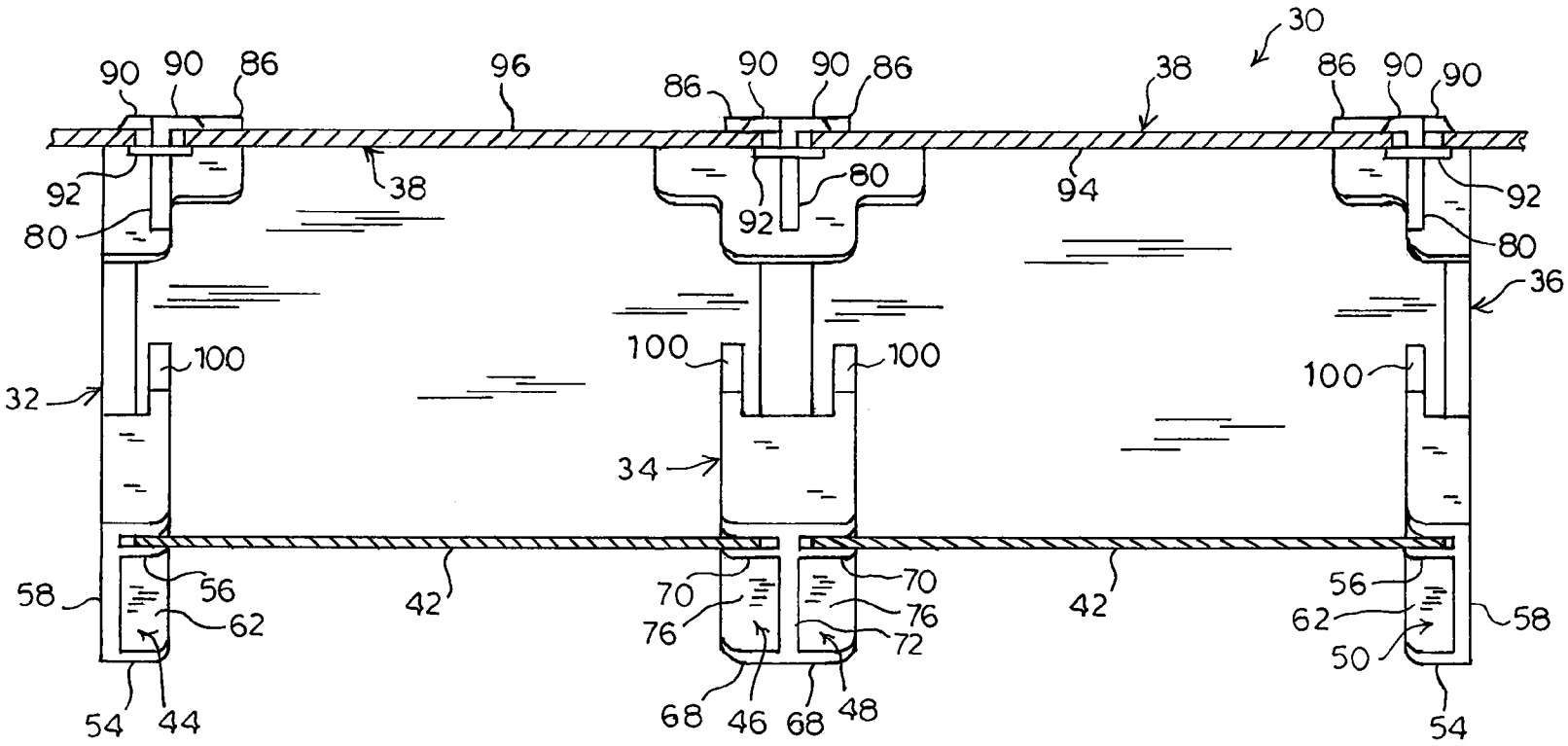
FIG. 12 is a top cross-section view of an apparatus for supporting and displaying paint color cards showing paint color cards.

As best shown in FIG. 12, a pocket for receiving paint chips is defined by a pair of brackets 32, 34, 36. More specifically, the channels 44, 50 for the end brackets 32, 36 and the opposed channels 46, 48 on the opposite sides of the intermediate bracket 34 open inwardly and form the pockets. Each pocket is configured and dimensioned for removably supporting and displaying a plurality of stacked paint chips, usually corresponding to at least one color and finish of a paint color intended to be represented. Each plurality of paint chips may be inserted into the associated channels and distal portions of the paint chips are supportingly received in the end of the channels partially defined by the end wall 62, 76. The proximal portion of the paint chips are exposed forwardly of an overlying pocket member for clear visual observation and easy removal and replacement. Each pocket permits display of the paint chips in a manner which presents their full face. A paint chip may be withdrawn from each pocket through an open end simply by lifting the paint chip from between the brackets 32, 34, 36.

FIG. 1 shows one embodiment of an arrangement of apertures 40 and brackets 32, 34, 36 on a mounting panel 38. The apertures 40 may be arranged in a plurality of columns and rows, which columns and rows of apertures may be substantially equally spaced apart. The width between columns may be selected to create alignment between adjacent indexing apertures and the engaging clips on a bracket, or to minimize space between adjacent pockets defined by the brackets. The spacing between rows may be selected to accommodate the size of the paint chips and permit pockets to be closely packed together, for example, in a conventional vertically cascading arrangement. By "vertically cascading arrangement" it is meant that each installed bracket is partially overlapped by at least one bracket installed adjacently below it. Outwardly canting the brackets, as described above, is one method for facilitating partial overlap of adjacent installed brackets. In other embodiments, varying degrees of overlap may be accommodated.

In alternative arrangements, the distance between sets of apertures 40 for receiving an associated pair of brackets 32, 34, 36 may be selected to accommodate paint chips of different sizes, or to provide different card pocket densities on the mounting panel 38. In other words, an irregular pattern is also contemplated in one embodiment. In this way, each pocket is capable of being arranged in any of a top-to-bottom, side-to-side, full-face or overlapping configuration using the same mounting apparatus with no modification to the individual brackets 32, 34, 36 being necessary. This allows for flexibility in displaying paint chips.

A particularly advantageous feature allows the brackets 32, 34, 36 to be selectively positionable so that the width or height of a corresponding pocket formed by the brackets can be adjusted to adapt to individual paint chips. This is accomplished by modifying the configuration of the apertures 40 of the mounting panel 38. The apertures 40 may be adjusted laterally or vertically relative to each other to accommodate paint chips or other articles of widely varying sizes and shapes. In this manner, the brackets 32, 34, 36 can be quickly converted to use for displaying paint chips larger or smaller than those of average size, modifying a pocket depending upon the physical dimensions of the chip which is to be displayed. Moreover, the distance between brackets 32, 34, 36 may accommodate paint chips of larger or smaller size without resort to replacement or disassembly of the display. Utilizing this feature, the overall horizontal and vertical dimensions of the display apparatus can be varied, thus providing greater flexibility in the system which, in effect, is only limited by the dimensions of the mounting panel 38 and the physical limitations of the surface upon which the mounting panel 38 is to be mounted. Thus, it is understood that the present disclosure is not limited to any particular width or height dimensions of the brackets or pockets or other components.

In use, the forwardmost paint chip of a group in a pocket may be readily removed by sliding the paint chip upwardly over the surface of the next rearward paint chip so as to withdraw the forwardmost paint chip from the pocket. In an alternative embodiment, the brackets 32, 34, 36 may be arranged to define a pocket that is adapted to allow a prospective paint customer to remove paint chips contained within the pocket from a side, as opposed to from the top. If the pocket is configured to allow for removal of paint chips from the side, then it is preferred for the brackets 32, 34, 36 to overlap in a side to side manner.

Referring to FIGS. 4 and 8, each bracket 32, 34, 36 comprises a partial inner wall 98 oppositely disposed rearward of the rear wall 56, 70. The partial inner wall 98 may be positioned substantially halfway along and adjacent the inner edge of the rear wall 56, 70. The lower end of the inner wall 98 is angled outwardly forming a retention projection 100. The partial inner wall 98 and the rear wall 56, 70 define a slot 99 of suitable size for holding a paint chip. The retention projection 100 is arranged at a midpoint in an opening in the rear wall 56, 70 so as to engage and push the paint chip forwardly against the rear wall 56, 70 and thus hold the paint chip in place. The slot 99 may serve to retain behind the rear walls 56, 70 of the brackets at least one paint chip representative of the paint chips contained in the pocket. Frictional contact of the terminal ends of the projections 100 with the paint chip maintains the chip in position within the pocket. The paint chip is representative of the color and finish on each of the plurality of paint chips stored in a corresponding pocket and serves as a reference for the supply of chips to be replenished when they are exhausted from the pocket. Retaining one "permanent" paint chip behind the rear wall 56, 70 in the bracket prevents potential paint customers from attempting to remove the last paint chip of a given color and finish, thereby ensuring future potential paint customers will be able to view the representative paint chip even before the supply has been replenished.

Figure 13:
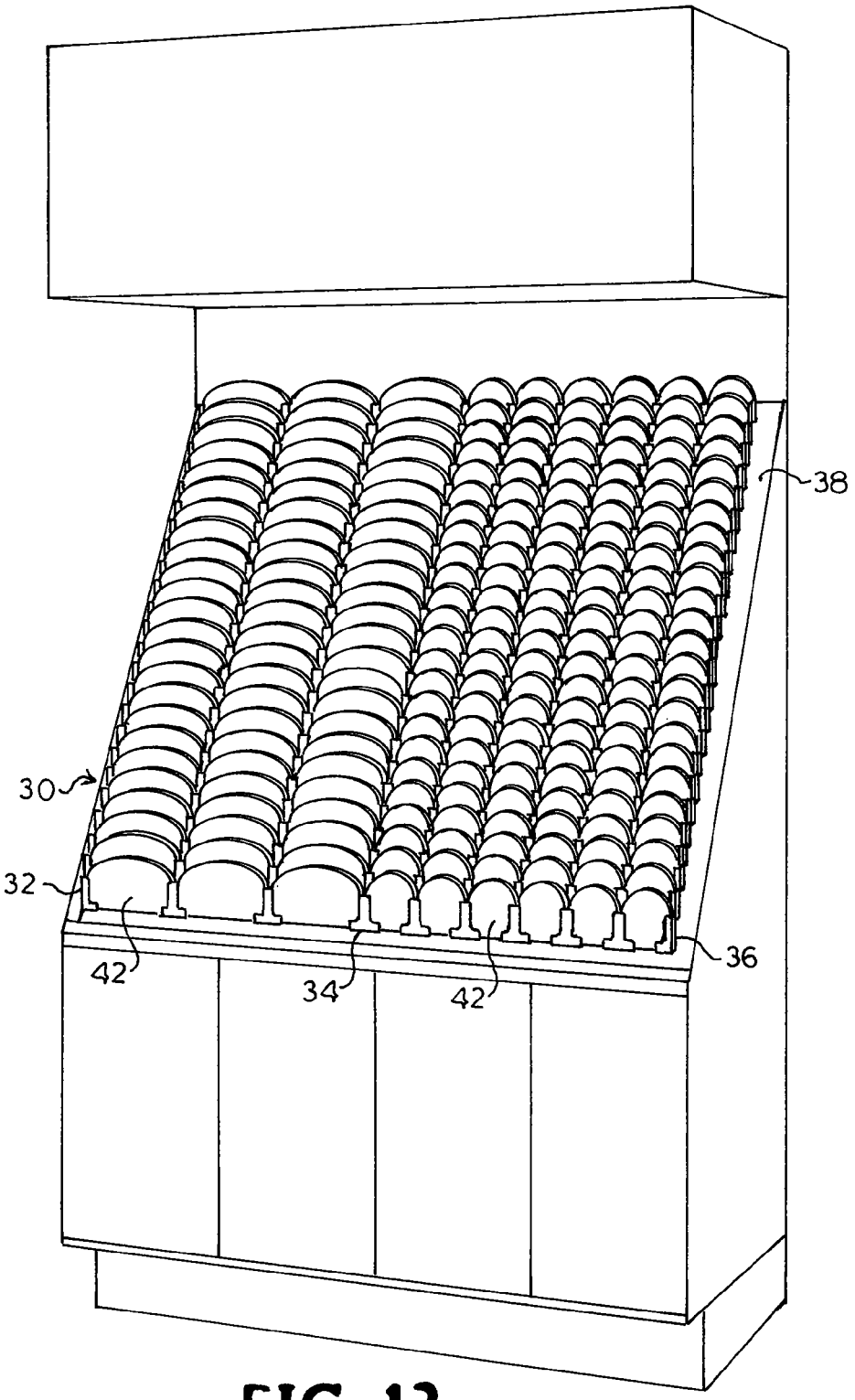
FIG. 13 is a perspective view of a system for supporting and displaying paint color cards showing a plurality paint color cards held in a cascading arrangement of pockets.

In one embodiment, the mounting panel 38 may be incorporated into a display stand (FIG. 13), such as is often found associated with the sale of paint, and paint color cards. The display stand may be supported by legs or by any other suitable base, which extends to the floor or which can rest on a table, counter or other supporting structure to dispose the shelf units at an elevation which is conveniently accessible to the user. The display stand may include a unit to which the mounting panel 38 may be attached by any suitable means. The display may further include a light, which may be direct or indirect lighting supplied by incandescent or fluorescent light bulbs or other light emitters. The light may be disposed above the mounting panel 38 so as to illuminate the pockets formed by the brackets installed on the mounting panel 38. The display may be rotatable so as to permit selective viewing of different sections from a forward position.

Alternatively, in another embodiment, the mounting panel 38 may be affixed to a surface, such as a wall, using conventional means such as adhesives, nails, screws, staples or any other suitable means.

Although the apparatus for supporting and displaying paint chips has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, other planar card-like or sheet-like objects, and groups of cards, or card-like objects may be supported by the brackets for display. The pockets formed by the brackets provide a product-bearing assembly capable of supporting any type of three-dimensional product, and is ideally suited for supporting and displaying products of generally rectilinear configuration such as printed media, generally including magazines, product brochures, newspapers, books, greeting cards, packaged multi-media and the like. Moreover, the pockets could be adapted to display a variety of non-printed materials, including non-printed media. It is appreciated that the apparatus is capable of use with an unlimited variety of articles, which broad use is intended to be comprehended herein. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. An apparatus for supporting and displaying a planar object when connected to a mounting substrate defining at least one aperture, the supporting and displaying apparatus comprising:

an elongated body member having a longitudinal axis, the body member comprising a planar web terminating in longitudinal edges, a front wall and a rear wall extending from the longitudinal edges of the web and terminating in longitudinal edges, the front wall and the rear wall extending the length of the web, the web, the front wall and the rear wall terminating at their proximal ends in free edges, and an end wall extending transversely with respect to and engaging the distal ends of the web, the front wall and the rear wall such that the web and the front and rear walls and the end wall define a longitudinal channel open at the proximal end and closed at the distal end for supporting the objects; and a pair of arms extend rearwardly from the body member, the arms are formed on their ends with lugs extending transversely in opposite directions, at least one of the arms resiliently deflectable in a direction transversely of the longitudinal axis of the body member for engagement and retention of the lugs in the at least one aperture of the mounting substrate, wherein during connection of the supporting and displaying apparatus to the mounting substrate the lugs are adapted to engage the portion of the mounting substrate defining the at least one aperture for moving the at least one of the arms inwardly so that the lugs pass through the aperture for permitting the arms to move outwardly and the lugs engage the mounting substrate to releasably connect the body member to the mounting substrate, and wherein to disconnect the body member the arms are moved inwardly causing disengagement of the lugs from the mounting substrate so that the lugs pass through the opening allowing the body member to be moved away from the mounting substrate.

2. The supporting and displaying apparatus as recited in claim 1, wherein the distance between the front wall and the rear wall is sufficient to hold a plurality of planar objects.

3. The supporting and displaying apparatus as recited in claim 1, wherein the front wall and the rear wall are joined to the web intermediate the longitudinal edges of the front and rear walls, such that the web, the front wall and the rear wall and the end wall define opposed longitudinal channels.

4. The supporting and displaying apparatus as recited in claim 1, wherein a first arm of the pair of arms is adjacent the closed distal end of the body member, and the second arm of the pair of arms is longitudinally spaced toward the open proximal end of the body member, and wherein the lug on the first arm is spaced a lesser distance from the body member than the lug on the second arm such that when connected to the mounting substrate the closed distal end of the body member is closer to the mounting substrate than the open proximal end of the body member.

5. The supporting and displaying apparatus as recited in claim 1, wherein the pair of arms are coplanar and longitudinally spaced.

6. The supporting and displaying apparatus as recited in claim 1, further comprising a flange extending rearwardly from adjacent the closed distal end of the body member and terminating in a longitudinal edge transverse to the longitudinal axis of the body member, and a downwardly extending planar edge portion integral with the longitudinal edge of the flange and terminating in a longitudinal edge, wherein the planar edge portion of the flange is adapted to be received in the at least one aperture in the mounting substrate.

7. The supporting and displaying apparatus as recited in claim 1, further comprising at least one shoulder extending rearwardly of the body member and adapted for engagement with the mounting substrate to prevent movement of body member toward the mounting substrate.

8. The supporting and displaying apparatus as recited in claim 1, further comprising a plate member extending longitudinally rearwardly from the rear wall of the body member adjacent to the closed distal end of the body member to a point intermediate the length of the rear wall, the plate member tapering outwardly from the closed distal end of the body member, and wherein the pair of arms extending rearwardly from the plate member.

9. The supporting and displaying apparatus as recited in claim 8, wherein a first arm of the pair of arms is adjacent the closed distal end of the body member, and the second arm of the pair of arms is longitudinally spaced toward the open proximal end of the body member such that the lug on the first arm is spaced a less distance from the body member than the lug on the second arm.

10. The supporting and displaying apparatus as recited in claim 1, further comprising a retention wall extending from the web adjacent to and only partially coextensive in length with the rear wall and terminating in a angularly directed tab, the web, rear wall and retention wall defining a slot for receiving a planar object, the tab adapted to engage the planar object for urging the planar object against the rear wall.

11. A system for supporting and displaying planar objects, the supporting and displaying system comprising:

a substrate having a mounting surface defining a plurality of spaced openings a plurality of brackets for receiving and supporting the objects, each bracket comprising an elongated body member having a longitudinal axis, the body member including a planar web terminating in longitudinal edges, a front wall and a rear wall extending from the longitudinal edges of the web and terminating in longitudinal edges, the front wall and the rear wall extending the length of the web, the web, the front wall and the rear wall terminating at their proximal ends in free edges, and an end wall extending transversely with respect to and engaging the distal ends of the web, the front wall and the rear wall such that the web and the front and rear walls and the end wall define a longitudinal channel open at the proximal end and closed at the distal end for supporting the objects; and a pair of arms extend rearwardly from the body member, the arms are formed on their ends with lugs extending transversely in opposite directions, at least one of the arms resiliently deflectable in a direction transversely of the longitudinal axis of the body member for engagement and retention of the lugs in the at least one aperture of the mounting substrate, wherein during connection of the brackets to the substrate the lugs are adapted to engage the mounting surface defining the at least one opening for moving the at least one of the arms inwardly so that the lugs pass through the opening permitting the arms to move outwardly and the lugs to engage the substrate to releasably connect the brackets to the substrate in spaced relationship with the channels of adjacent brackets facing each other for receiving and supporting at least a portion of the planar objects extending between the facing channels of the brackets for visual observation and ease of removal of the objects for inspection, and wherein to disconnect the bracket the arms are moved inwardly causing disengagement of the lugs from the substrate so that the lugs pass through the opening allowing the bracket to be moved away from the substrate.

12. The supporting and displaying system as recited in claim 11, wherein the distance between the front wall and the rear wall is sufficient to hold a plurality of planar objects.

13. The supporting and displaying system as recited in claim 11, wherein the front wall and the rear wall are joined to the web intermediate the longitudinal edges of the front and rear walls, such that the web, the front wall and the rear wall and the end wall define opposed longitudinal channels.

14. The supporting and displaying system as recited in claim 11, wherein a first arm of the pair of arms is adjacent the closed distal end of the bracket, and the second arm of the pair of arms is longitudinally spaced toward the open proximal end of the bracket, and wherein the lug on the first arm is spaced a lesser distance from the bracket than the lug on the second arm such that when connected to the substrate the closed distal end of the bracket is closer to the substrate than the open proximal end of the bracket.

15. The supporting and displaying system as recited in claim 11, wherein the pair of arms are coplanar and longitudinally spaced.

16. The supporting and displaying system as recited in claim 11, further comprising a flange extending rearwardly from adjacent the closed distal end of the brackets and terminating in a longitudinal edge transverse to the longitudinal axis of the brackets, and a downwardly extending planar edge portion integral with the longitudinal edge of the flange and terminating in a longitudinal edge, wherein the planar edge portion of the flange is adapted to be received an opening in the substrate.

17. The supporting and displaying system as recited in claim 11, further comprising at least one shoulder extending rearwardly from the brackets and adapted for engagement with the substrate to prevent movement of brackets toward the substrate.

18. The supporting and displaying system as recited in claim 1, further comprising a plate member extending longitudinally rearwardly from the rear wall of the brackets from adjacent to the closed distal end of the brackets to a point intermediate the length of the rear wall, the plate member tapering outwardly from the closed distal end of the brackets, and wherein the pair of arms extending rearwardly from the plate member.

19. The supporting and displaying system as recited in claim 18, wherein a first arm of the pair of arms is adjacent the closed distal end of the brackets, and the second arm of the pair of arms is longitudinally spaced toward the open proximal end of the brackets such that the lug on the first arm is spaced a less distance from the brackets than the lug on the second arm.

20. The supporting and displaying system as recited in claim 11, further comprising a retention wall extending from the web adjacent to and only partially coextensive in length with the rear wall and terminating in a angularly directed tab, the web, rear wall and retention wall defining a slot for receiving a planar object, the tab adapted to engage the planar object for urging the planar object against the rear wall.

21. The supporting and displaying system as recited in claim 11, wherein the brackets are sized for displaying an upper portion of a major surface of the objects.

22. The supporting and displaying system as recited in claim 11, wherein at least a portion of the brackets are arranged on the substrate such that the longitudinal axes of the brackets are disposed substantially vertically.

23. The supporting and displaying system as recited in claim 11, wherein at least a portion of the brackets are arranged on the substrate such that the longitudinal axes of the brackets are disposed substantially horizontally.

24. The supporting and displaying system as recited in claim 11, wherein at least a portion of the brackets are arranged on the substrate in a partially overlapping shingled relationship.

* * * * *